US012024354B2

(12) United States Patent
Smith

(10) Patent No.: US 12,024,354 B2
(45) Date of Patent: Jul. 2, 2024

(54) INSULATION BOX LINER AND SYSTEM WITH METHODS OF PRODUCTION AND USE

(71) Applicant: Steven Howard Smith, Villages, FL (US)

(72) Inventor: Steven Howard Smith, Villages, FL (US)

( * ) Notice: Subject to any disclaimer, the term of this patent is extended or adjusted under 35 U.S.C. 154(b) by 88 days.

(21) Appl. No.: 17/728,937

(22) Filed: Apr. 25, 2022

(65) Prior Publication Data

US 2022/0250827 A1 Aug. 11, 2022

Related U.S. Application Data

(63) Continuation-in-part of application No. 16/867,422, filed on May 5, 2020, now Pat. No. 11,312,563.

(60) Provisional application No. 62/852,663, filed on May 24, 2019.

(51) Int. Cl.

| | |
|---|---|
| ***B65D 81/03*** | (2006.01) |
| ***B65B 5/02*** | (2006.01) |
| ***B65B 5/04*** | (2006.01) |
| ***B65D 81/38*** | (2006.01) |

(52) U.S. Cl.

CPC ..... *B65D 81/3823* (2013.01); *B65B 5/028* (2013.01); *B65B 5/04* (2013.01); *B65D 81/03* (2013.01); *B65D 81/3816* (2013.01); *B65D 81/3818* (2013.01)

(58) Field of Classification Search

CPC ..... B65D 81/3823; B65D 81/3816; B65D 81/3818; B65D 81/03

USPC ..... 206/521, 583

See application file for complete search history.

(56) References Cited

U.S. PATENT DOCUMENTS

| | | | | |
|---|---|---|---|---|
| 5,638,979 | A * | 6/1997 | Shea | B65D 81/3897 220/592.21 |
| 5,820,268 | A | 10/1998 | Becker et al. | |
| 6,007,467 | A | 12/1999 | Becker et al. | |
| 7,452,316 | B2 | 11/2008 | Cals et al. | |
| 8,763,811 | B2 | 7/2014 | Lantz | |
| 8,887,515 | B2 | 11/2014 | Patstone | |
| 9,233,787 | B2 * | 1/2016 | Nakamura | B65D 81/055 |
| 10,252,833 | B2 * | 4/2019 | Hao | B65D 25/10 |
| 2004/0231355 | A1 | 11/2004 | Mayer | |
| 2008/0289302 | A1 | 11/2008 | Vulpitta | |
| 2009/0193765 | A1 | 8/2009 | Lantz | |
| 2011/0100868 | A1 | 5/2011 | Lantz | |
| 2012/0248101 | A1 | 10/2012 | Tumber et al. | |
| 2013/0140213 | A1 * | 6/2013 | Padden | B32B 3/266 428/116 |

(Continued)

*Primary Examiner* — Steven A. Reynolds
(74) *Attorney, Agent, or Firm* — Connie R. Masters

(57) ABSTRACT

Provided is an insulation liner for use inside a shipping carton that affords thermal insulation and shock absorption for an object to be shipped, a liner and carton system, a method of production of the insulation liner, and methods of use. The insulation liner includes a larger component folded into three panels, a smaller component folded into three panels, and standoffs disposed on the surfaces of both the larger component and the smaller component. The standoffs may be oriented inwardly or outwardly. When oriented outwardly they create an interstitial air space that reduces conduction allowing the insulation effect of the liner and carton system to equal or exceed that of a molded polystyrene container of an equal size.

13 Claims, 15 Drawing Sheets

(56) References Cited

U.S. PATENT DOCUMENTS

2014/0319018 A1* 10/2014 Collison ..... B65D 81/3858
428/34.3
2019/0315541 A1* 10/2019 Gray ..... B65D 11/1873

* cited by examiner

INSULATION BOX LINER AND SYSTEM WITH METHODS OF PRODUCTION AND USE

CROSS-REFERENCE TO RELATED APPLICATIONS

This application is a continuation-in-part of co-pending U.S. patent application Ser. No. 16/867,422 that was filed on May 5, 2020, (issuing on Apr. 26, 2022, as U.S. Pat. No. 11,312,563), which claims priority to U.S. Provisional Patent Application No. 62/852,663, filed on May 24, 2019, and which are both incorporated herein in their entirety.

FIELD OF INVENTION

The invention relates generally to a packing product and more particularly to an environmentally friendly shipping carton liner that improves insulation characteristics while reducing storage and transportation costs.

BACKGROUND OF THE INVENTION

Some types of products that are to be shipped, such as pharmaceutical products, medical products, and food products, are temperature sensitive. To preserve the quality of the product, insulation packaging is required that, ideally, ensures that the temperature inside the packaging is maintained within a predefined range.

Various types of packaging have been developed to insulate the product to be shipped. Some insulation packaging involves a product surrounded by a cushioning material, such as plastic film air chambers, inflatable cushions, fibrous nonwoven sheets or pads such as cotton fibers, crumpled paper, foam peanuts formed of expanded polystyrene or starch, or shredded packing materials such as paper; the product is supported within the interior space of the exterior box with the packaging material disposed around it. This cushioning material does not hold its shape in the box, does not perform as well to regulate temperatures as polystyrene containers, and may become dislocated, thus reducing the shock absorbency and temperature regulation. Production of this bulky packaging wastes resources. This conventional packaging is susceptible to mechanical damage, does not provide a high degree of insulation, and, for the end user or consumer, presents a disposal problem with limited options for recycling.

Metalized bubble box liners may also be used to ship temperature-sensitive products but are poor insulators. The exterior of the metalized bubble liner touches the sides of the outer carton and, thus, conducts heat to the outer carton.

A commonly used type of insulation packaging is a molded container made from a foam material, which is typically expanded polystyrene (also known as "EPS" or "polystyrene foam") but which is sometimes made from starches, such as corn, bamboo, sugar cane pulp, and the like. Foam provides a good insulation effect and can be formed into desired shapes and sizes. But because the cost to create the molds is quite high, the molded containers are only available in a limited number of sizes and shapes. Typically, the foam may be molded into a lower chest-like portion and a snug-fitting lid portion that together form an inner container that is to be placed into an outer shipping carton. However, heat conduction readily occurs because the outer walls of this inner foam container touch the inner walls of the outer carton.

The use of expanded polystyrene to form the molded containers has several disadvantages. Producing the expanded polystyrene is energy intensive and produces environmental contaminants such as flame retardants, styrene, pentane, and plasticizers. The expanded polystyrene containers cannot be composted, and recycling opportunities for expanded polystyrene are limited. The humidity in a polystyrene foam container may reach between 80%-90% due to the typically used cooling elements (such as cold packs) and the tight-fitting lid, which can damage moisture sensitive products, such as bakery products.

Starch-based molded foam containers are recyclable but are expensive to produce. Consequently, they are expensive for the end user.

Additionally, molded foam containers (both EPS and starch-based) are pre-formed into the final shape of the container, which includes the formed lid and the formed chest-like container portion having an interior open space that will receive the product to be shipped. Thus, unavoidably, because they cannot be folded, collapsed, or otherwise deformed, the cost to transport the bulky molded foam containers to the shipping facility, to a retail outlet, or to the consumer is high, the warehouse space needed to store the foam containers before use at the shipping facility or business is large, greater shelf space is required for the retailer selling the foam containers, and the end user needs a larger storage area.

Accordingly, there is a need for an insulation box liner and a need for an insulation box liner and outer carton system that can be economically shipped to the retailer or end used, that can be stored compactly before use for shipping, that can be disposed of easily, that provides an environmentally friendly alternative to polystyrene foam containers, that provides shock absorption, and that delivers thermal insulation comparable to or better than the thermal insulation provided by expanded polystyrene containers of a similar size.

BRIEF SUMMARY OF THE INVENTION

The present invention is directed to an insulation liner for use inside a shipping carton, to an insulation liner and outer carton system, and to methods of production and use. The insulation liner for use inside a shipping carton is designed to address all three thermal issues—conduction, convection, and radiation—as well as providing shock absorption for the object or objects to be shipped. The insulation liner also can be shipped flat and stored flat before use, thus reducing the cost to ship the container to retail stores or end users and reducing the space needed for storage before usage. Additionally, the insulation liner is economical to produce.

In overview, the insulation liner includes two folding components and standoffs. The folding components interlay to fit within an outer carton and form an interior space to receive the product to be shipped. An air gap is maintained between the two folding components and the inner walls of the outer carton by standoffs.

The insulation liner comprises a thin larger component folded or foldable into three sections or panels, a thin slightly smaller component folded or foldable into three sections or panels, and multiple standoffs disposed on surfaces of the larger component and the smaller component. In the first embodiment, these standoffs are oriented outwardly and serve to keep the outer surfaces of the two liner components at a distance from the inner walls of the shipping carton. The smaller component is oriented in a transverse direction of the larger component, i.e., rotated ninety degrees from the larger component, to allow the smaller component to fit within the edges of the larger component. Because of this transverse orientation of the two components within the outer shipping carton, the height of the slightly smaller component is equal or only slightly less than the width of the length section of the larger component.

In the second embodiment, the multiple standoffs are oriented toward the inner surfaces of the two components that form the box liner. This embodiment creates an air gap between the product to be transported and the box liner.

The larger folded component and smaller folded component both have an inner core and an outer casing that covers one or both sides of the inner core.

In one aspect of the invention, the outer casing forms a sheath or envelope into which the inner core is inserted so that the material of the sheath covers the front, back, and sides of the inner core.

In another aspect of the invention, the outer casing covers only one side of the inner core.

In a further aspect of the invention, the inner core of the larger folded component is formed of a sheet of corrugated fiberboard.

In an additional aspect of the invention, the inner core of the larger folded component is formed of a sheet of plastic.

In a further aspect of the invention, the inner core of the smaller folded component is formed of a sheet corrugated fiberboard.

In another aspect of the invention, the inner core of the smaller folded component is formed of a sheet plastic.

In an additional aspect of the invention, the outer casing of the larger folded component is formed of bubble foil.

In a further aspect of the invention, the outer casing of the larger folded component is formed of foam foil.

In another aspect of the invention, the outer casing of the larger folded component is formed of a reflective material.

In an additional aspect of the invention, the outer casing of the smaller folded component is formed of bubble foil.

In a further aspect of the invention, the outer casing of the smaller folded component is formed of foam foil.

In another aspect of the invention, the outer casing of the smaller folded component is formed of a reflective material.

In an additional aspect of the invention, the reflective material is a metalized polyester.

In a further aspect of the invention, the reflective material is a metalized polypropylene.

In another aspect of the invention, the standoffs are formed of corrugated paperboard or fiberboard.

In an additional aspect of the invention, the standoffs are formed of honeycomb paperboard or fiberboard.

In a further aspect of the invention, the standoffs are formed of foam.

In another aspect of the invention, the standoffs are formed of plastic.

In an additional aspect of the invention, the standoffs are formed of a flexible and/or rubber-like material.

In a further aspect of the invention, the standoffs support the insulation liner at a distance of at least 10 mm from the inner walls of the shipping carton.

In another aspect of the invention, the standoffs have the shape of a cube.

In an additional aspect of the invention, the standoffs have the shape of a rectangular prism.

In a further aspect of the invention, the standoffs have the shape of bars.

In another aspect of the invention, the standoffs have an irregular shape.

In an additional aspect of the invention, the standoffs have the shape of a cylinder.

In a further aspect of the invention, the multiple standoffs are disposed on the outer surfaces of the two components that form the box liner.

In another aspect of the invention, the multiple standoffs are disposed on the inner surfaces of the two components that form the box liner.

In an additional aspect of the invention, the larger folded component and the smaller folded component can be shipped and stored flat to reduce shipping and storage costs.

The object of the invention is to provide an insulation liner for use inside a shipping carton that can be shipped flat and affords thermal insulation plus shock absorption for at least one object to be shipped, to provide an insulation liner and outer carton system, to provide methods of production, and to provide methods of use that give an improved performance over the above described prior art systems and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward an insulation liner for use inside a shipping carton and is directed to a combination system of the insulation liner and outer carton. The present invention is further directed to methods of production and use of the same. The insulation liner provides thermal insulation and shock absorption for at least one object to be shipped. The insulation liner advantageously can be shipped flat to the retail store, business, or end user and can be stored flat until needed for shipping. Additionally, the insulation liner is substantially recyclable.

Figure 1:
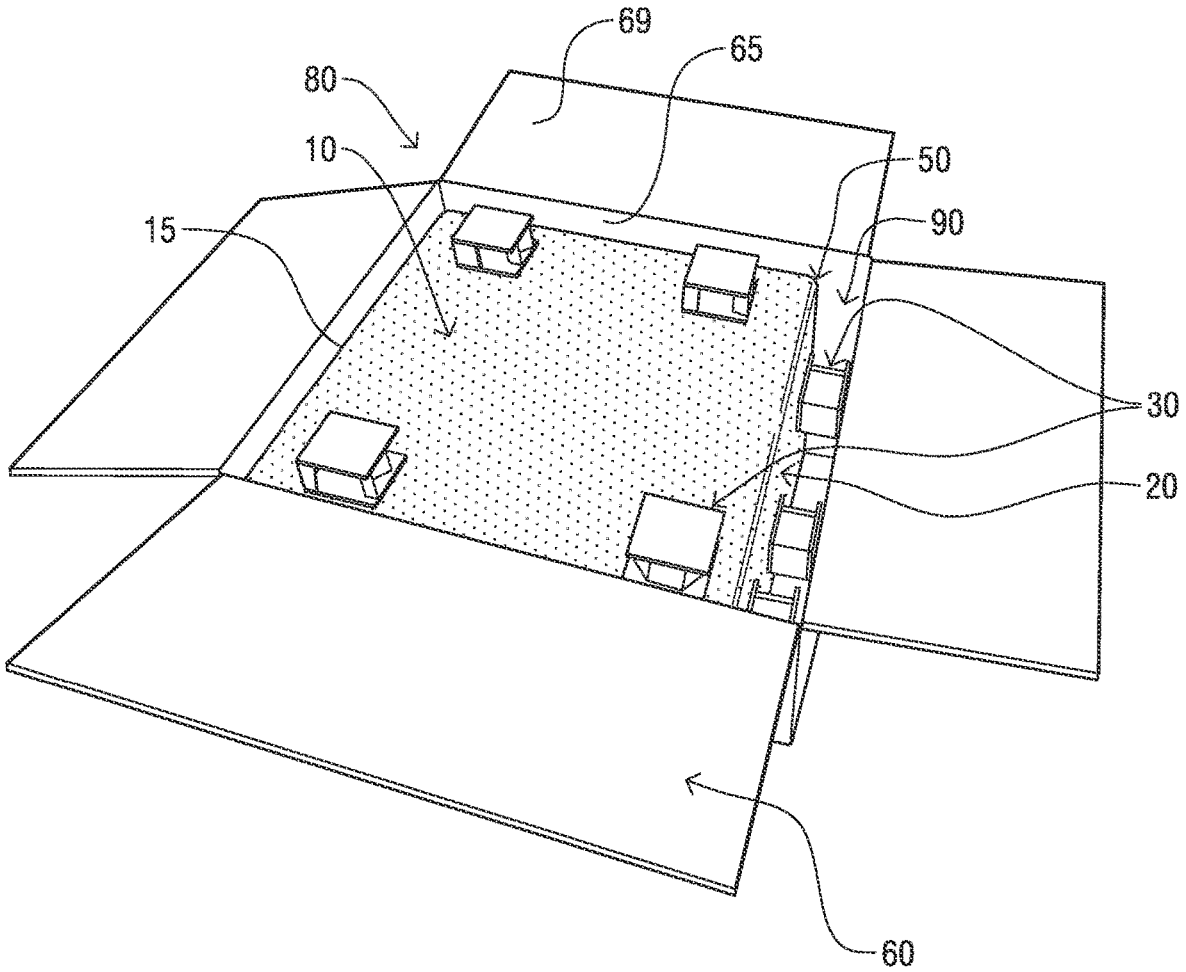
FIG. 1 is a top perspective view of a first embodiment of the present invention of the insulation box liner inserted into an outer shipping carton.
Figure 2:
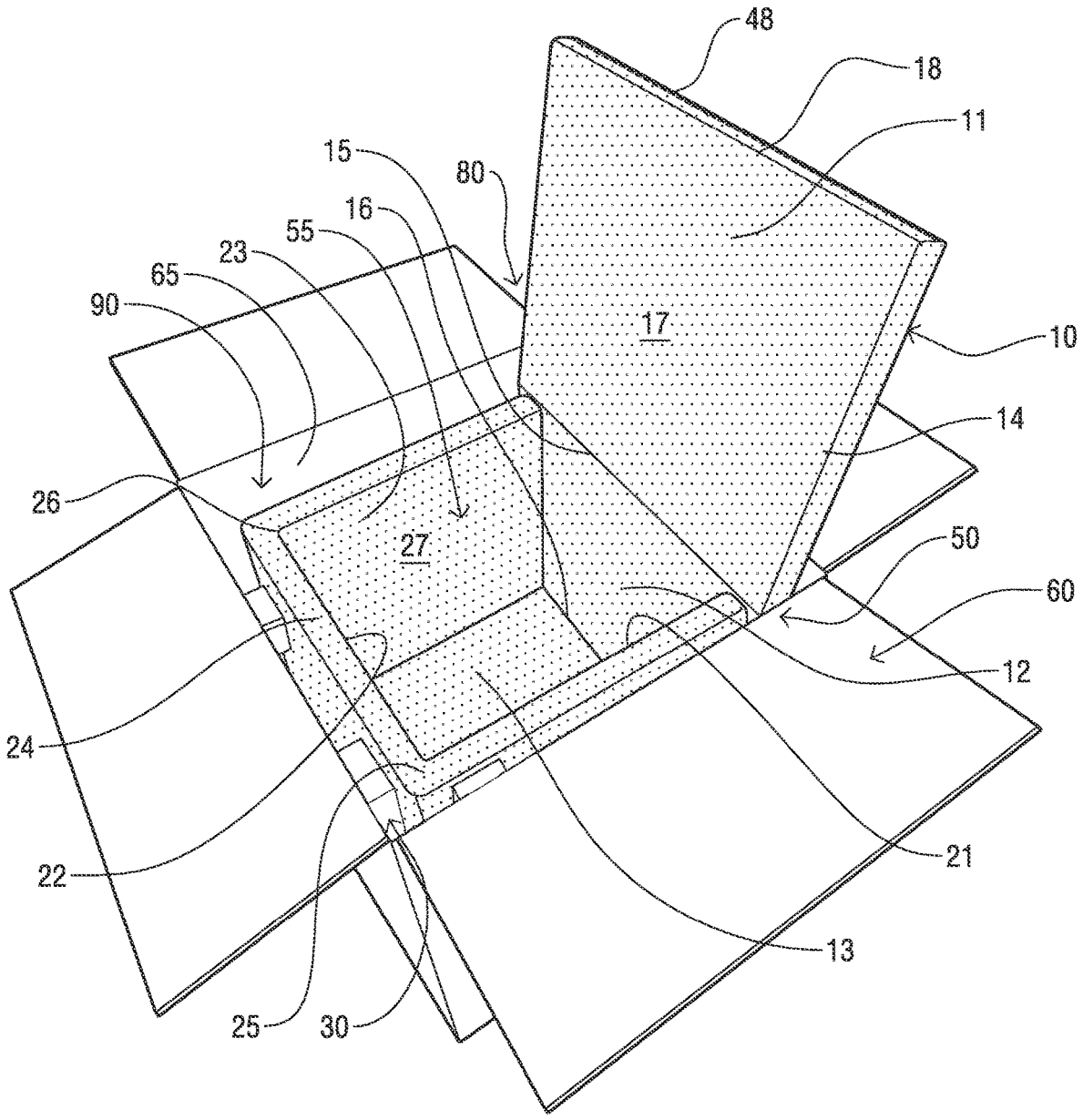
FIG. 2 is a top perspective view of the first embodiment of the present invention looking into the interior of the insulation box liner that has been inserted into an outer shipping carton.
Figure 3:
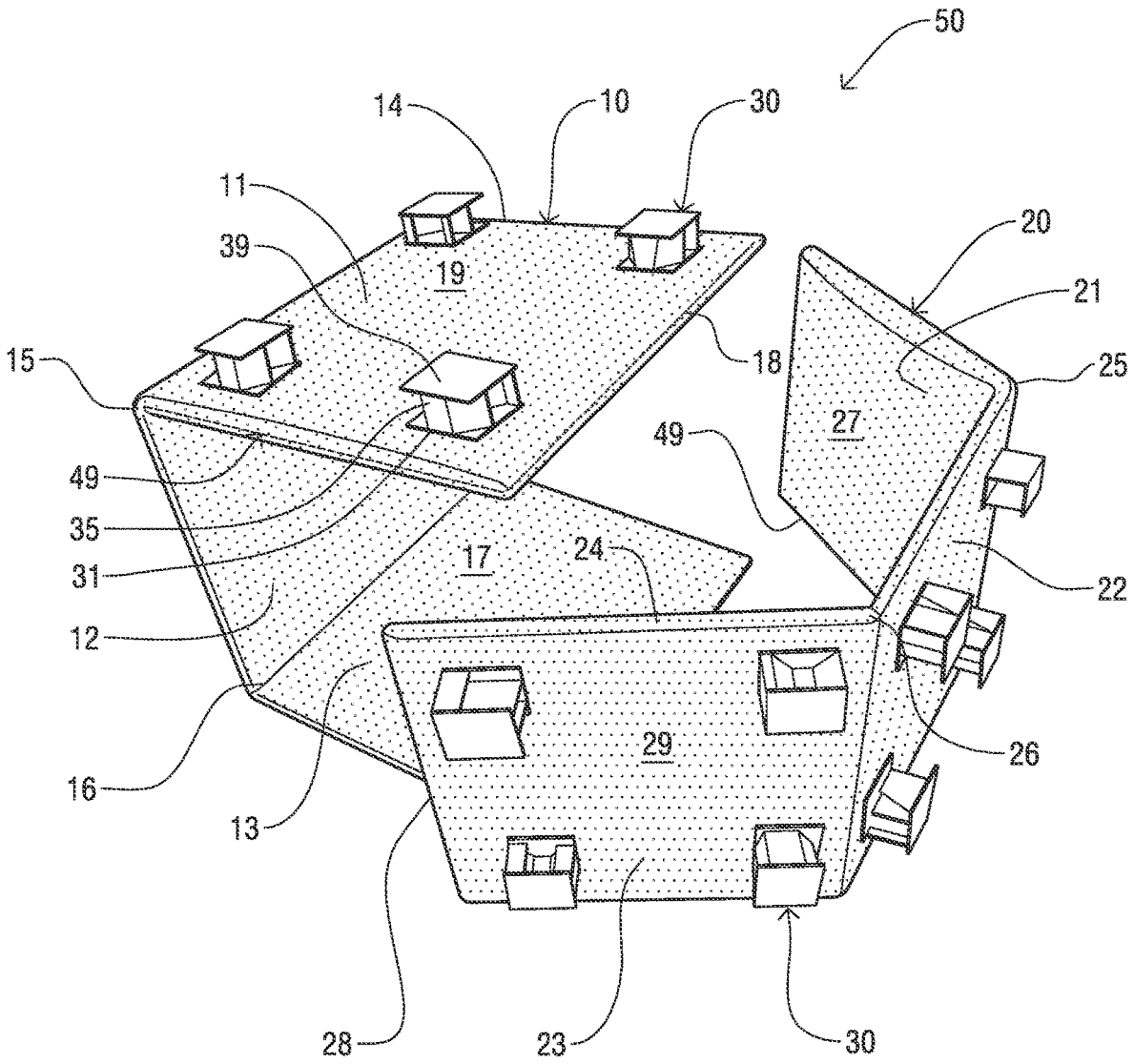
FIG. 3 is a top perspective expanded view of the first embodiment of the present invention of the two components of the insulation box liner that are transversely oriented for installation into an outer shipping carton.

Referring now to FIGS. 1-3, an insulation liner, shown generally as reference number 50, is illustrated in accordance with a first embodiment of the present invention. As oriented in FIG. 3, the insulation liner 50 comprises a larger component 10 (comprising panels 11, 12, 13), a slightly smaller component 20 (comprising panels 21, 22, 23), and outwardly oriented standoffs 30 disposed on an outer surface of both liner components 10, 20. Each of the liner components 10, 20 are folded into three sections or panels to be used together to form an insert that is placed into an outer shipping carton 60. In the orientation shown in FIG. 3, the middle panel 12 of the larger component 10 is disposed between wing panels 11, 13. The wing panel 11 forms the top of the liner 50, the wing panel 13 forms the bottom of the liner 50, and the middle panel 12 forms one side of the liner 50. Similarly, the slightly smaller component 20 includes a middle panel 22 disposed between the first wing panel 21 and the second wing panel 23. The three panels 21, 22, 23 of the liner component 20 form the sides of the liner 50, as shown.

In the first embodiment, the outer (when in the folded configuration) surfaces 19, 29 of each of the three panels 11, 12, 13 of the larger component 10 and of the panels 21, 22, 23 of the smaller component 20 are configured with standoffs 30. Each of the six panels 11, 12, 13, 21, 22, 23 have standoffs 30 that function to support the six panels 11, 12, 13, 21, 22, 23 of the insulation liner 50 set apart a distance from the inner walls of the outer carton 60 to create an interior generally open interstitial space 90 or "air gap." In some aspects, there are multiple standoffs 30 on each of the panels as seen in FIG. 1, but in other aspects, one standoff 30 will serve to space the panel a distance from the inner wall of the outer carton 60, such as seen with the standoff 30 disposed on panel 11 of FIG. 9.

FIGS. 1-2 also show the liner and carton combination insulated packaging system 80 that includes both the insulation liner 50 and the outer shipping carton 60.

The larger component 10 extends in length from the first lateral end 18 to the opposing second lateral end 71 (FIG. 4) and extends in width from the longitudinal end 14 to the opposing longitudinal end 78. The smaller component 20 extends in length from the first lateral end 28 to opposing second lateral end 72 (FIG. 4) and extends in width from longitudinal end 24 to the opposing insertion lateral end 79.

Figure 5:
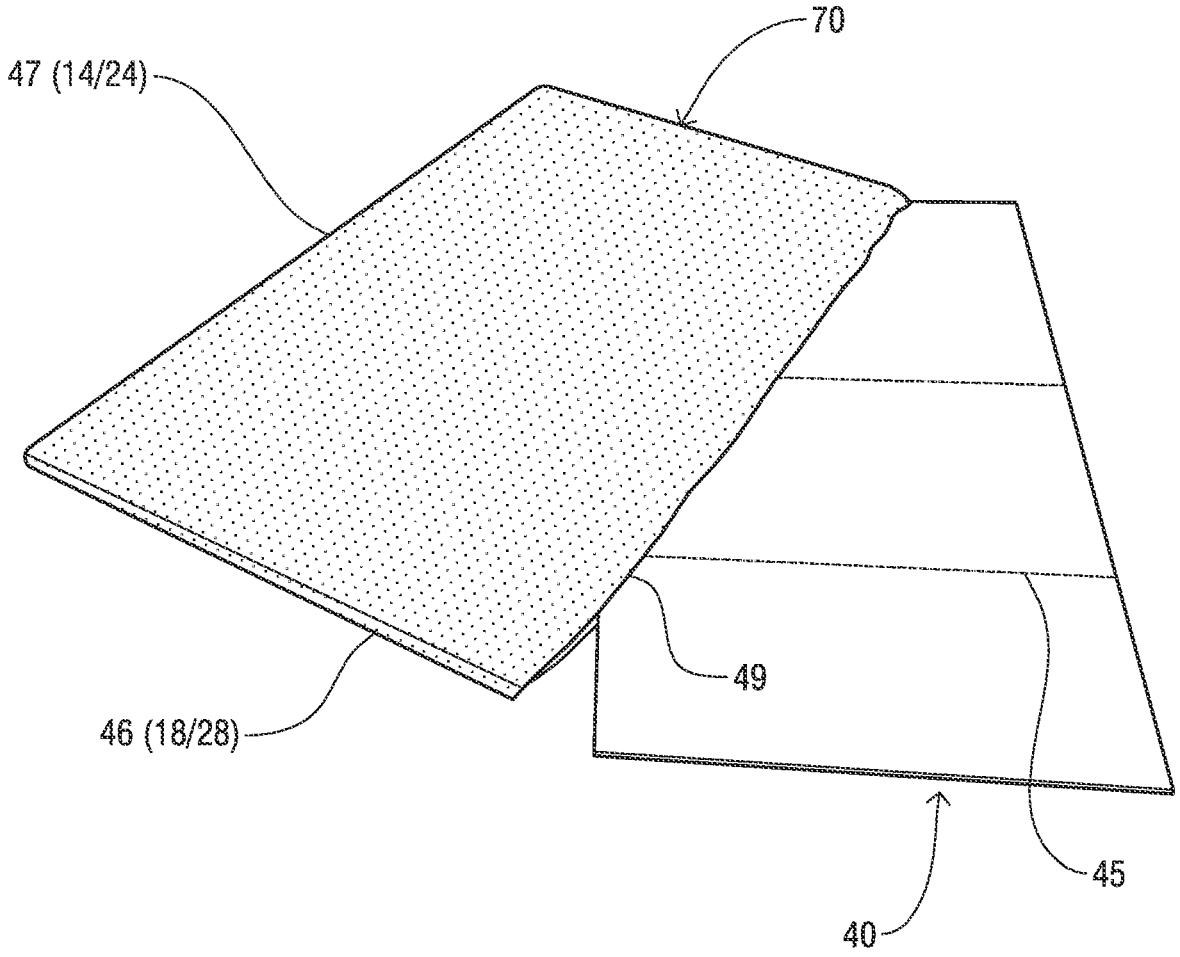
FIG. 5 is a perspective view of a step in manufacturing a larger or smaller liner component of the insulation box liner of an embodiment of the present invention.
Figure 6:
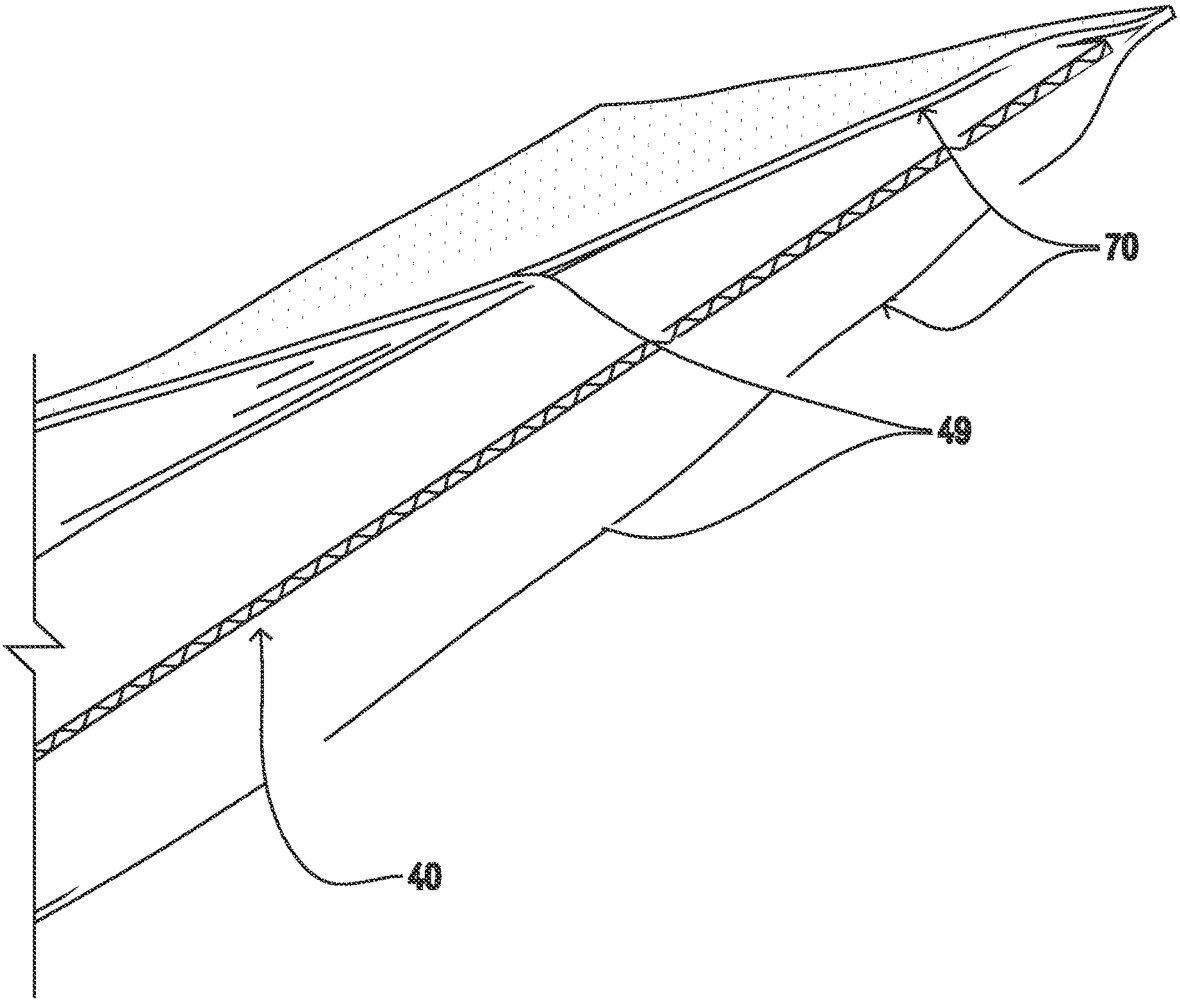
FIG. 6 is a close-up perspective view of a portion of one liner component in a step in manufacturing the insulation box liner of an embodiment of the present invention.

In the double-sided aspect of the first embodiment, as seen in FIGS. 5-6, both the larger liner component 10 and the smaller liner component 20 are formed with an inner core 40 (FIGS. 5-6) covered on all sides with an outer casing 70. The inner core 40 is a planar sheet of material configured with crease lines 45 that allow the liner component 10 and the liner component 20 of the insulation liner 50 to easily bend to form corners 15, 16, 25, 26 to facilitate the assembly and formation of the box liner. The crease lines 45 may be formed by bending, creasing, stamping, pressing, perforating, or by other methods that facilitate the folding of the inner core 40 of liner components 10, 20.

The inner core 40 is preferably formed of corrugated fiberboard but may optionally be formed of plastic, paper-based honeycomb packaging material (such as one-half inch or one inch), fabric material, or a composite material. The corrugated fiberboard used for the inner core 40 of the larger liner component 10 may be (but is not required to be) of the same test strength as the test strength of the inner core 40 of the smaller liner component 20. Any single wall or double wall corrugated fiberboard may be used, but preferably a C-flute single wall corrugated fiberboard comprising two flat linerboards with a fluted corrugate sheet held between them is used. C-flute single wall corrugated fiberboard typically has 39-43 flutes per foot and has a thickness of 11/64 inch. In the aspect in which the inner core 40 is formed of a composite material, two types of material form (attached or adjacent) the inner core 40, such as a foam layer attached to a corrugated fiberboard, a polystyrene layer adjacent to the paperboard or fiberboard, a recycled fabric attached to a recycled plastic or to recycled paperboard or fiberboard, a denim fabric with a corrugated fiberboard, or a second material laminated to one or both sides of the corrugated fiberboard.

Figure 4:
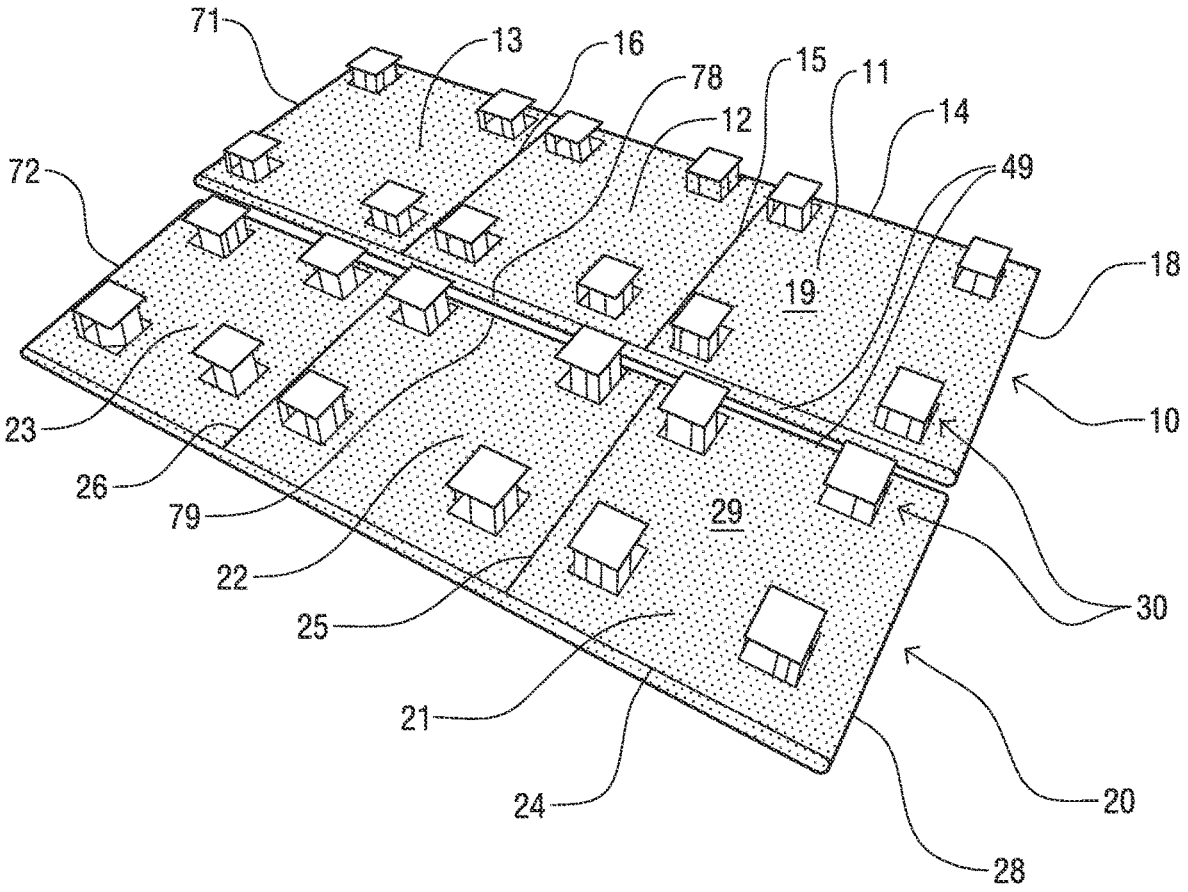
FIG. 4 is a top perspective view of the two liner components of the insulation box liner of the first embodiment of the present invention that are in a flat position upon a horizontal surface.

The outer casing 70 is formed of a reflective material, such as bubble foil, foam foil, or metalized material, which may be formed of metalized polyester, metalized polypropylene, or other materials that act to reflect thermal radiation. In one aspect of the invention, the reflective material is vapor-coated with a metal layer, which may be around 50 nanometers thick. Preferably, the outer casing 70 is slightly longer than the length of the inner core 40 to allow for seaming along the lateral ends 18, 71, 28, 72 (FIG. 4). In the double-sided aspect of the invention, the outer casing 70 is preferably slightly wider than the width of the inner core 40 to allow for seaming along at least the insertion longitudinal ends 78, 79 (FIG. 4).

In the aspect of the invention in which the outer casing 70 is formed of a single piece of material, the outer casing 70 is preferably folded at substantially the longitudinal midline 47. When the outer casing 70 is folded, the edge 14 of the larger component (and/or the edge 24 of the smaller component 20) is located at the midline fold 47. The lateral edges 46 of the outer casing form the ends of the two liner components 10, 20. The one-piece outer casing 70 is folded and formed into a pocket or envelope with outer edges 49 defining the insertion opening of the envelope into which the core 40 will be inserted. Then outer edges 49 are sealed. This aspect in which the outer casing 70 is formed of a single piece of material, may reduce production costs because less cutting and sealing is required.

In another aspect of the invention, the outer casing 70 may be formed of two pieces of material. In this case, one piece of the two-piece outer casing 70 forms the inner surface 17 of the larger component 10 and one piece of the two-piece outer casing 70 forms the outer surface 19 of the larger liner component 10. The two pieces of the two-piece outer casing 70 are seamed at all four edges (the lateral ends 18, 71, and the longitudinal edges 14, 78), which forms a sealed envelope to cover all sides of the inner core 40. Similarly, to form the smaller liner component 20, the two pieces of the outer casing would form the inner surface 27 and the outer surface 29 with all four edges seamed at lateral ends 28, 72 and longitudinal ends 24, 79 to form a sealed envelope sized and shaped to accommodate the inner core 40 within the interior space. This aspect in which the outer casing 70 is formed of two pieces of material may provide advantages in that the material can be dispensed with an upper roller of material and a lower roller of material without requiring folding of the material.

Figure 7:
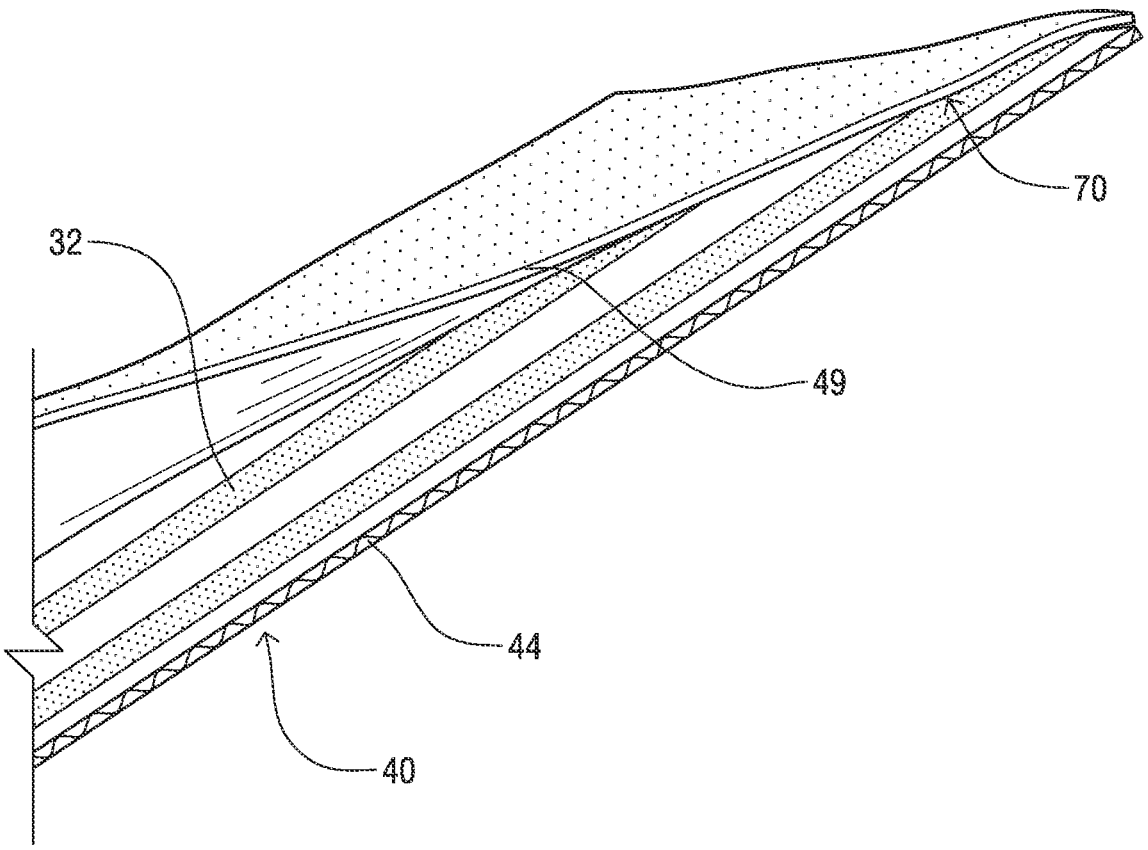
FIG. 7 is a close-up perspective view of a portion of one liner component in a step in manufacturing the insulation box liner of an embodiment of the present invention in an aspect in which the outer covering is attached to only one side of the liner component.

In the single-sided aspect of the invention shown in FIG. 7, as opposed to the earlier figures, instead of the inner core 40 of both liner components 10, 20 being covered on all sides with a double-sided outer casing 70, the outer casing 70 is attached to only one side of the inner core 40. As seen in FIG. 7 the single-sided outer casing 70, is fixedly adhered by adhesive to only one side of the outer casing 70. This single-side coverage of the inner core 40 provides a cost reduction for materials, since only one half of the amount of outer casing material is used.

Figure 15:
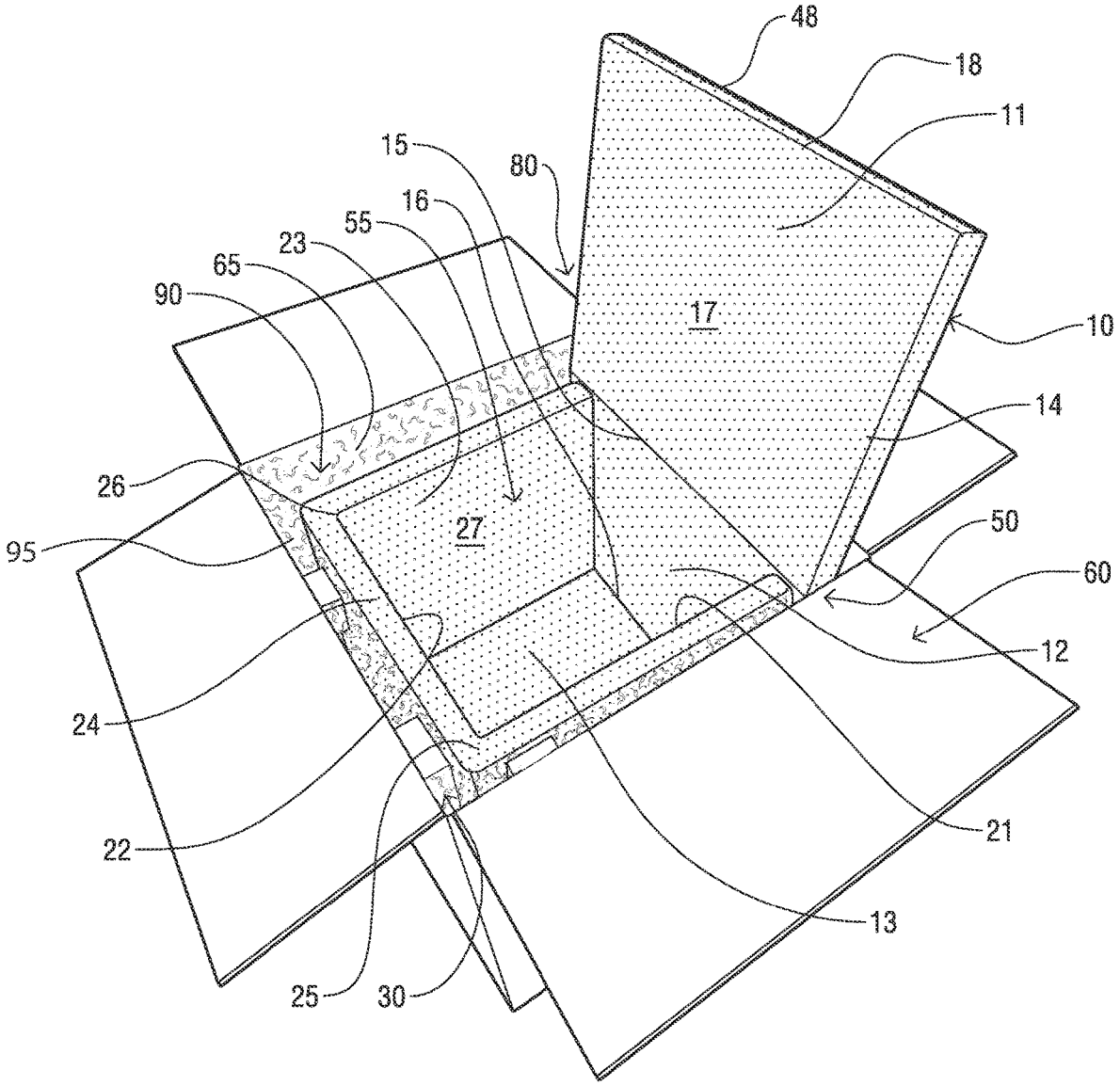
FIG. 15 is a top perspective view of the first embodiment of the present invention looking into the interior of the insulation box liner that has been inserted into an outer shipping carton, which shows a light or wispy material in the interstitial space.

In the embodiments, one or multiple standoffs 30 are attached to the exterior surfaces 19, 29 of the larger and smaller components 10, 20, respectively. The standoffs 30 serve to suspend the insulation box liner 50 within the outer carton 60 to create an air gap or interstitial air space 90 between the liner 50 and the shipping carton 60. The interstitial air space 90 may preferably remain empty but may optionally be filled by a light and/or wispy packing material 95 (FIG. 15). The light packing material 95 does not need to be supportive enough to maintain the air gap, which is maintained by the standoffs 30, but instead may be light, fluffy, and/or wispy to minimize air movement.

The standoffs have an inner planar member 31 (FIG. 3), an outer planar member 39, and a vertically extending portion 35 that extends between the inner planar member 31 and the outer planar member 39. The inner planar member 31 is bonded, glued, or otherwise adhered to the surface of the insulation liner 50. Preferably the standoffs 30 project a distance of at least 5 mm and may project a distance of up to 30 mm, which will optimally reduce heat transfer, or may project a distance greater than 30 mm, for example, if additional shock resistance is needed for the particular product. The standoffs 30 can be formed from any of a variety of materials but are preferably formed of a material that is not a good conductor of heat. For example, the standoffs 30 may be formed of foam, honeycomb paperboard or fiberboard, corrugated fiberboard, plastic, or a combination of materials. In FIGS. 1-4, honeycomb corrugated material is illustrated, which has several desirable characteristics. It has a high stacking strength, is not a good conductor of heat, and is recyclable.

The standoffs 30 may be formed in any of a variety of shapes, such as square (FIGS. 1-4), cylindrical (FIG. 8), irregular (FIG. 9), or as bar-like long rectangular prisms (FIGS. 9-14), or in other regular or irregular shapes.

The size, number, and the specific placements of the standoffs 30 are dependent upon at least the size and shape of the insulation box liner 50 and upon the weight of the object to be shipped. In the example shown in FIGS. 1-4, there are four standoffs 30 on the exterior surfaces of each of the three panels of each of the two components 10, 20. The standoffs 30 are positioned at a location inset from the corners a distance that is similar to or somewhat larger than the width of a standoff 30. If a heavier object is to be shipped or if the box liner 50 is larger than illustrated, a center standoff 30 (not shown) may be easily added to provide additional support or bigger standoffs 30 may be used. In the example illustrated in FIGS. 1-4, the standoffs 30 are shown as approximately 25 mm in height and approximately 50 mm in length and width. To accommodate the particular weight of the payload, the size of the standoffs 30, the number of the standoffs 30 on each side, and the placement of the standoffs 30 may be varied. In some aspects, the number of standoffs 30 may vary from one panel to another panel. For example, if the liner 50 is not square as in the FIGS. 1-4 but is rectangular, as seen in FIG. 8, the longer panels may have more standoffs than the shorter panels.

Figure 8:
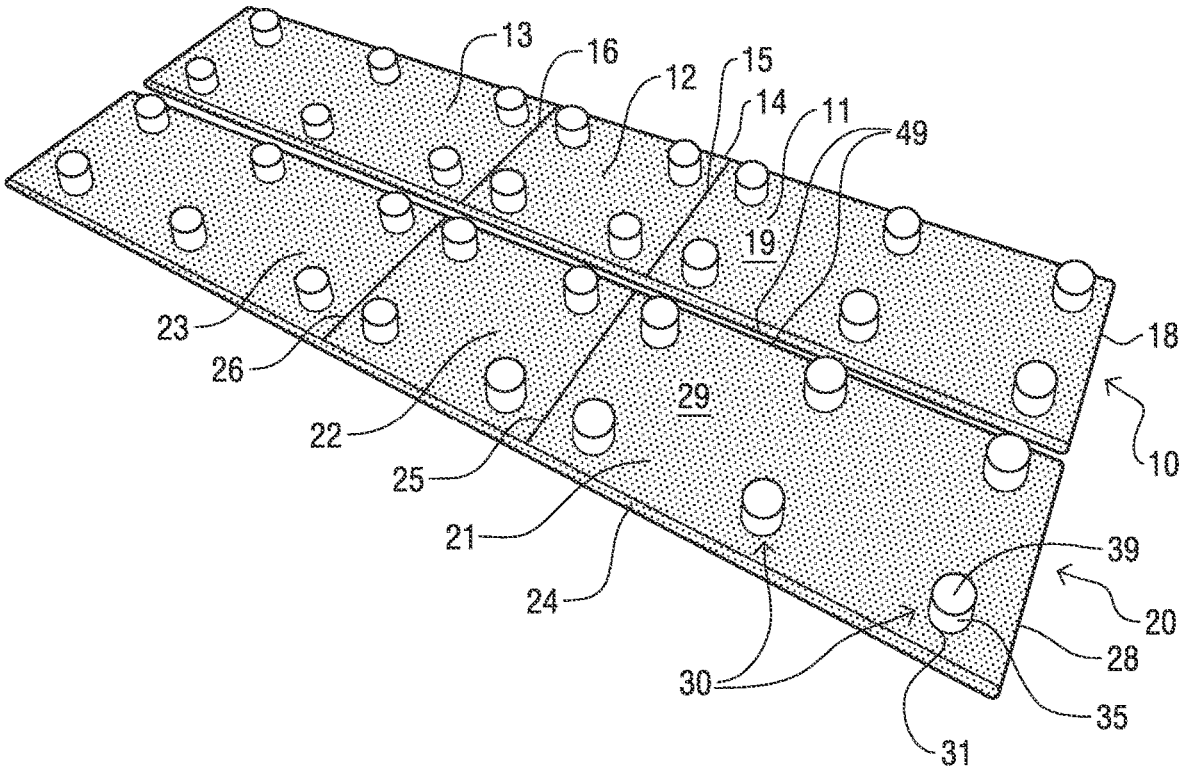
FIG. 8 is a top perspective view of the two components of the insulation box liner of an embodiment of the present invention that are in a flat position upon a horizontal surface.

FIG. 8 illustrates an aspect which varies from the earlier aspects in the shape and placement of the standoffs 30 and in the shape of the liner (and, therefore, the shape of the outer shipping parcel that is not shown would also vary), which is rectangular as opposed to the square box liner 50 of FIGS. 1-3.

Figure 9:
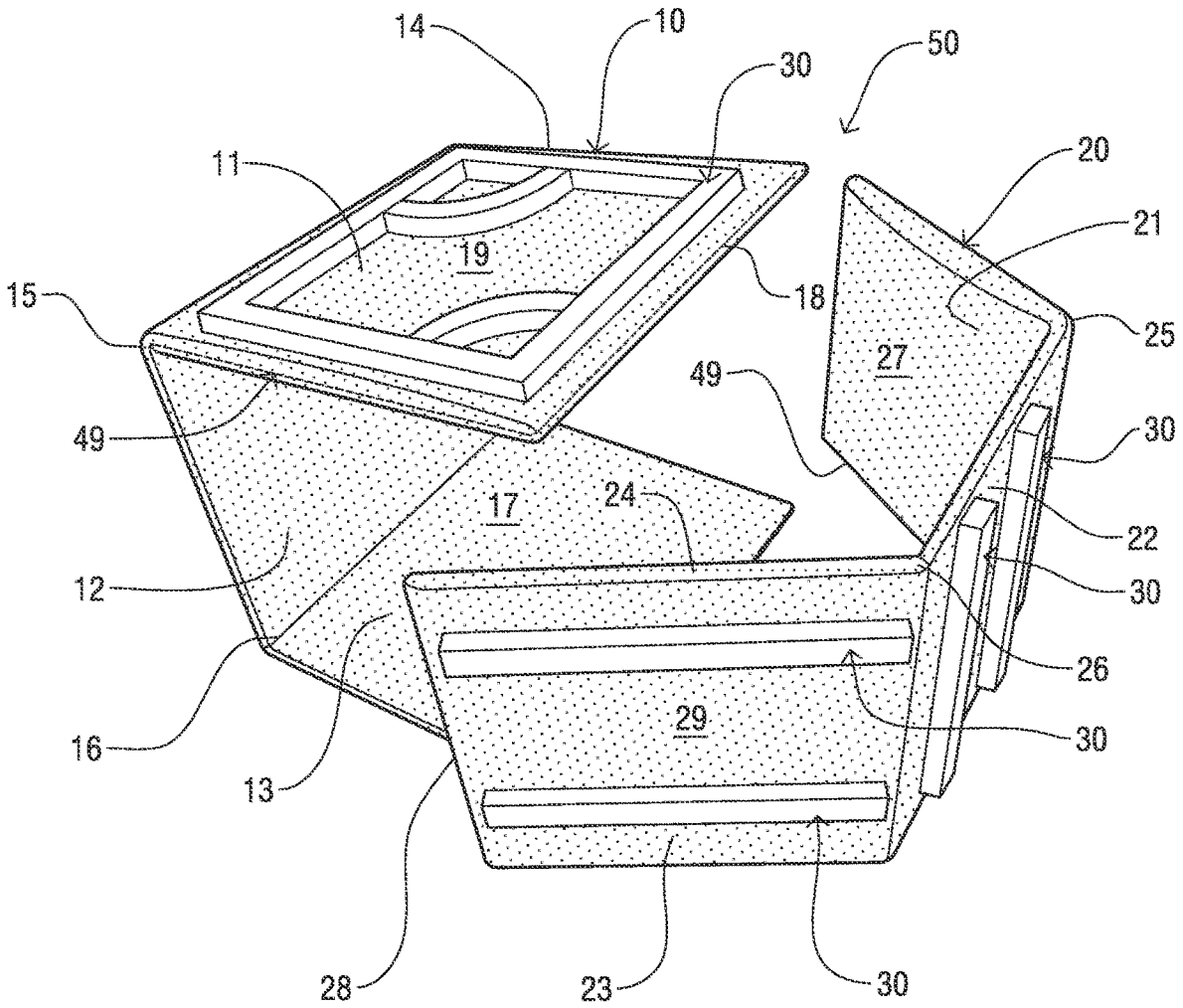
FIG. 9 is a top perspective view of an embodiment of the present invention of the insulation box liner showing variations in the standoff configurations.

FIG. 9 illustrates another aspect of the standoffs 30, in which the shape of the standoffs 30 vary from the shape of the standoffs 30 of the earlier figures. FIG. 9 demonstrates that one or more standoffs 30 may be disposed on the panels and demonstrates that the standoffs 30 on one panel need not match the number of the standoffs of other panels. Panel 23 has two bar-type elongated rectangular prisms disposed horizontally across its outer surface. Panel 22 has two bar-type elongated rectangular prisms disposed vertically on its outer surface. Panel ii has single, irregularly shaped standoff 30 disposed on the outer surface 19 of panel 11. The irregularly shaped standoff 30 extends both laterally and longitudinally to support the panel 11 a pre-determined interstitial distance from the interior surface of the outer carton. The elongated rectangular prism-shaped standoffs 30 and the irregularly-shaped standoff 30 may provide additional benefits in reducing convection in some designs.

In the embodiments, to allow the transverse orientation of the larger liner component 10 to the slightly smaller liner component 20, the height H1 (FIGS. 12, 13) of the slightly smaller liner component 20 is equal to or slightly less than the length D1 of the middle section 12 of the larger liner component 10, because the middle panel 12 forms one side of the liner 50 while the other three sides of the liner are formed by the slightly smaller liner component 20. The top and bottom of the liner 50 are formed by the wing panels 11, 13 of the larger liner component 10. The height H1 of the smaller component 10 is generally equal to the length D1 of the middle panel 12 of the larger component 10, because the smaller component is held between the outer edges of the top panel 11 and the bottom panel 13 of the larger liner component 10. Due to the variations in bending at the crease lines 45 and imprecision in manufacturing cutting and seaming, the absolute width of the finished middle panel 12 and the absolute height of the finished liner component 20 and may vary slightly. Thus, specifically, the height H1 of the middle panel 22 (and the entire liner component 20) might be equal to the length D1 of the middle panel 12 making an allowance for the thickness of the outer casing 70 and inner core 40, because the liner component 20 rests between the edges of wing panels 11, 13 of the larger liner component 10. But the thickness of the outer casing 70 and inner core 40 is small, and the variations possible due to the bending at the top and bottom of the middle panel 12 may be greater than the thickness of the outer casing 70 and inner core 40. Therefore, the terms "generally equal" or "equal to or just less than" is intended to accommodate variations in creasing and bending as well as manufacturing variations, with the understanding that the height H1 of the liner component 20 is at most equal to the length D1 of middle panel 12 and is generally slightly less than the length D1 of the middle panel 12.

Similarly, the length L1 (FIGS. 12, 13) of the middle section 22 of the slightly smaller liner component 20 is generally equal to the width W1 (FIG. 12) of the larger liner component 10. Also, the length D2 of the two wing panels 11, 13 of the larger component is generally equal to the length L2 of the two wing panels 21, 23 of the smaller component. Specifically, the length L2 of the two wing panels 21, 23 may be equal to the length D2 of the two wing panels 11, 13 less the thickness of the outer casing 70 and inner core 40 of the middle panel 12.

FIGS. 8, 10-13 illustrate that the middle panels 12, 22 may or may not be square, and that even when the middle panels 12, 22 are square, the wing sections 11, 13, 21, 23 do not need to be square. The wing panels 11, 13, 21, 23 may be longer or shorter than the width or length of the middle panels 12, 22. FIGS. 8, 10-13 show the wing panels 11, 13, 21, 23 as longer than the width or the length of the middle panels 12, 22.

Additionally, these figures illustrate more variations in the shape of the standoffs 30. The standoffs 30 of FIG. 8 have a circular inner planar member 31 and a circular outer planar member 39 that together with the vertically extending portion 35 form a cylindrical standoff 30. Though the inner planar member 31 and the outer planar member 39 are shown in the illustrations to have matching shapes, there is no requirement for this, and the shape of the inner planar member 31 may vary from the shape of the outer planar member 39.

Figure 10:
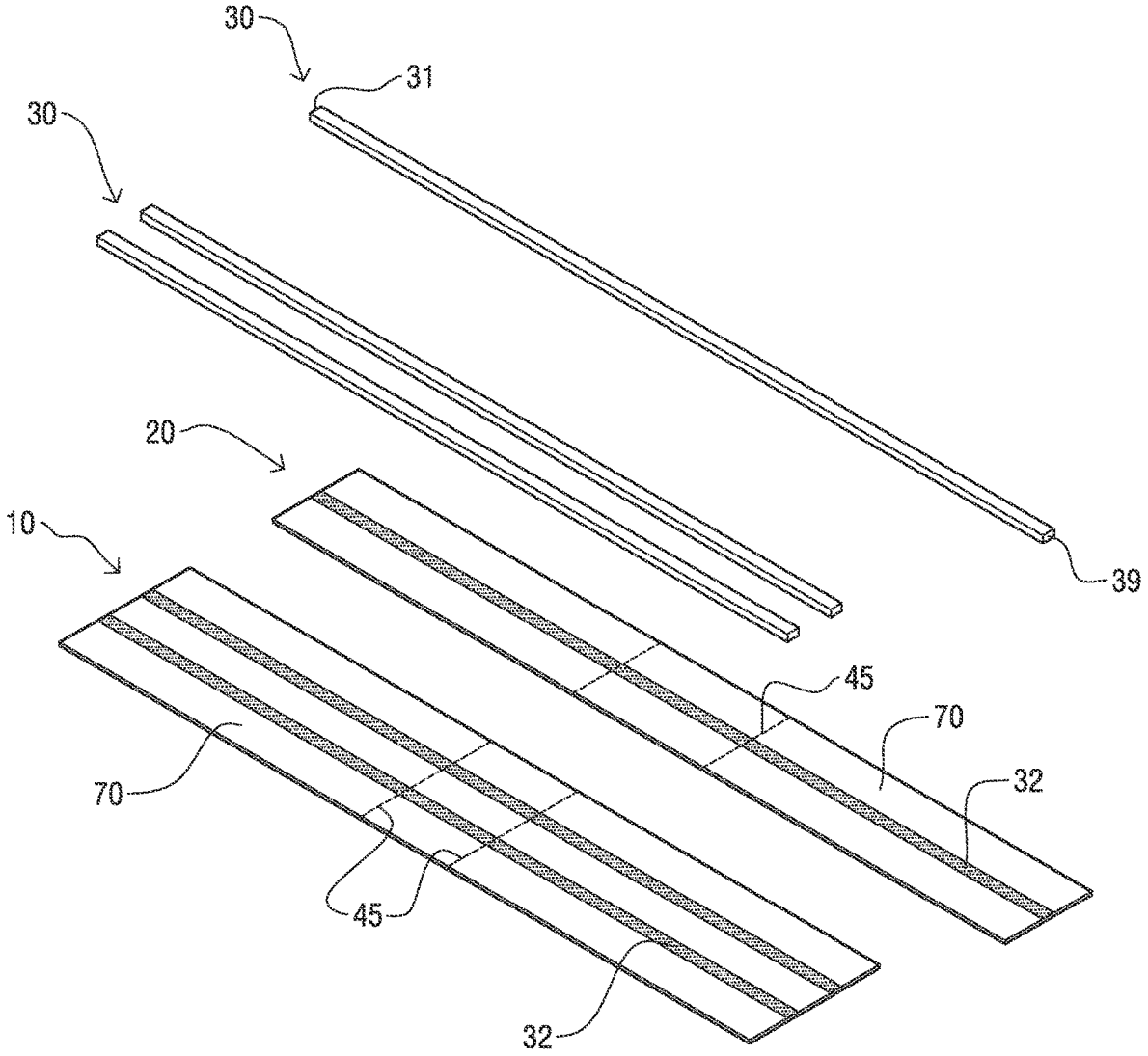
FIG. 10 is a perspective expanded view of the two liner components (with adhesive applied) and of multiple bar-type standoffs of an embodiment of the insulation box liner of the present invention.
Figure 11:
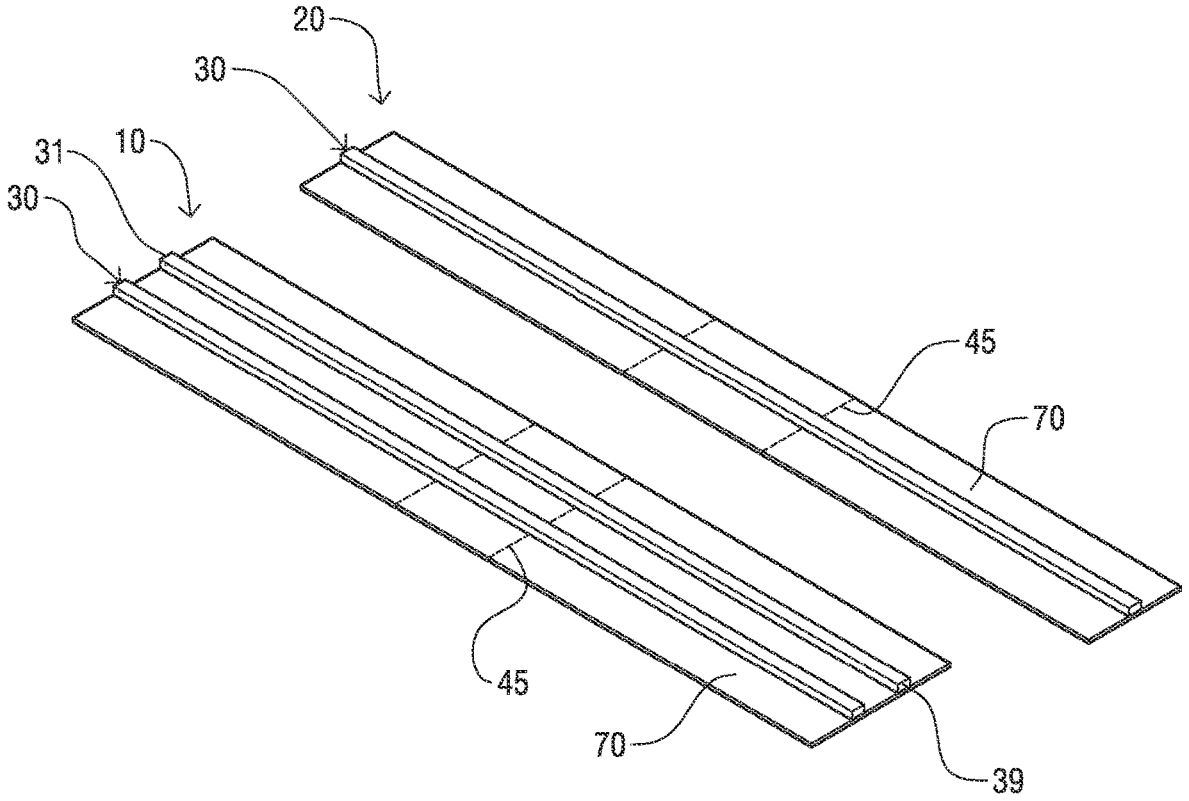
FIG. 11 is a perspective view of the two liner components and of multiple bar-type standoffs attached to the components in an embodiment of the insulation box liner of the present invention.

FIGS. 10-13 illustrate a method of constructing the liner 50 with bar-type standoffs 30 that are formed of strips of material extending outwardly from said outer casing 70. In FIG. 10, the two liner components 10, 20 are illustrated with adhesive 32 applied onto the outer casing 70 along the lines in pre-determined positions to which the inner planar member 31 of the bar-type standoffs 30 will be attached. The determination as to where to apply the adhesive is based on the desired placement of the standoffs 30. One (as shown on component 20), two (as shown on component 10), or more lines of adhesive may be applied, depending on the number of bar-type standoffs 30 that will be attached. The bar-type standoffs 30 extend from standoff end 31 to standoff end 39. The lines of adhesive may be solidly applied, as shown, or may be intermittently applied, as may be needed for the adhesive applied to be sufficient to secure the standoffs 30 to the outer casing 70.

Figure 12:
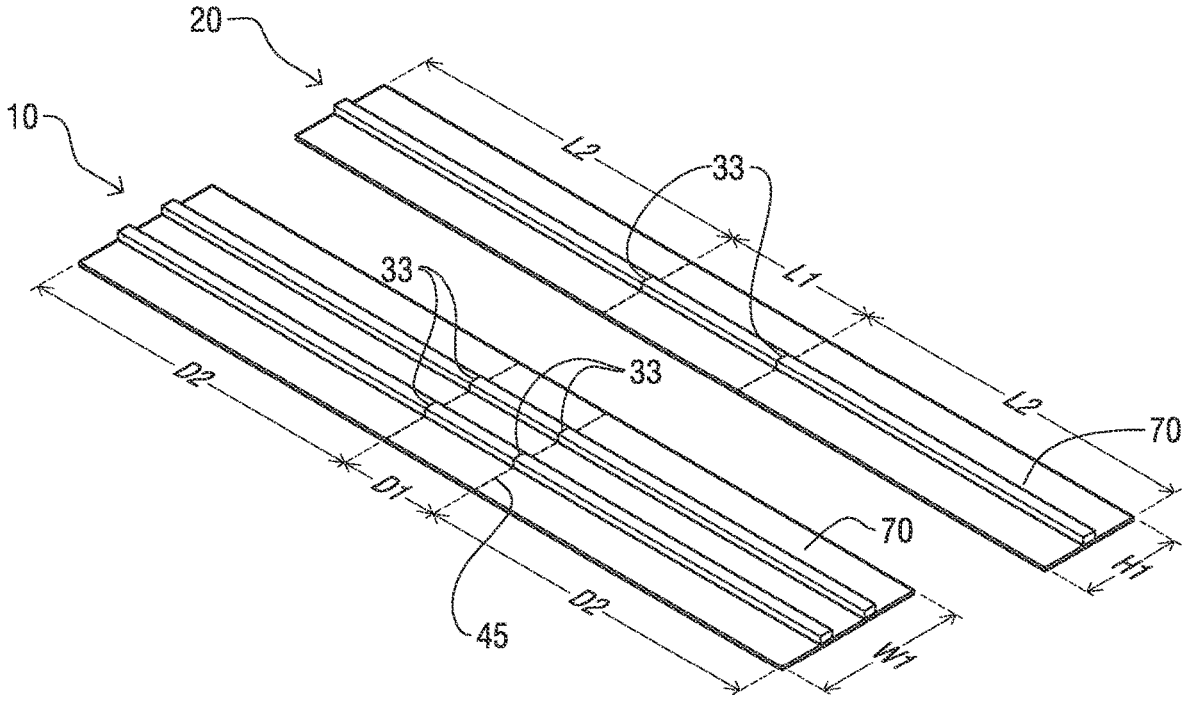
FIG. 12 is a perspective view of the two liner components and of multiple bar-type standoffs attached to the liner components with the bar-type standoffs slit to enable folding in an embodiment of the insulation box liner of the present invention.
Figure 13:
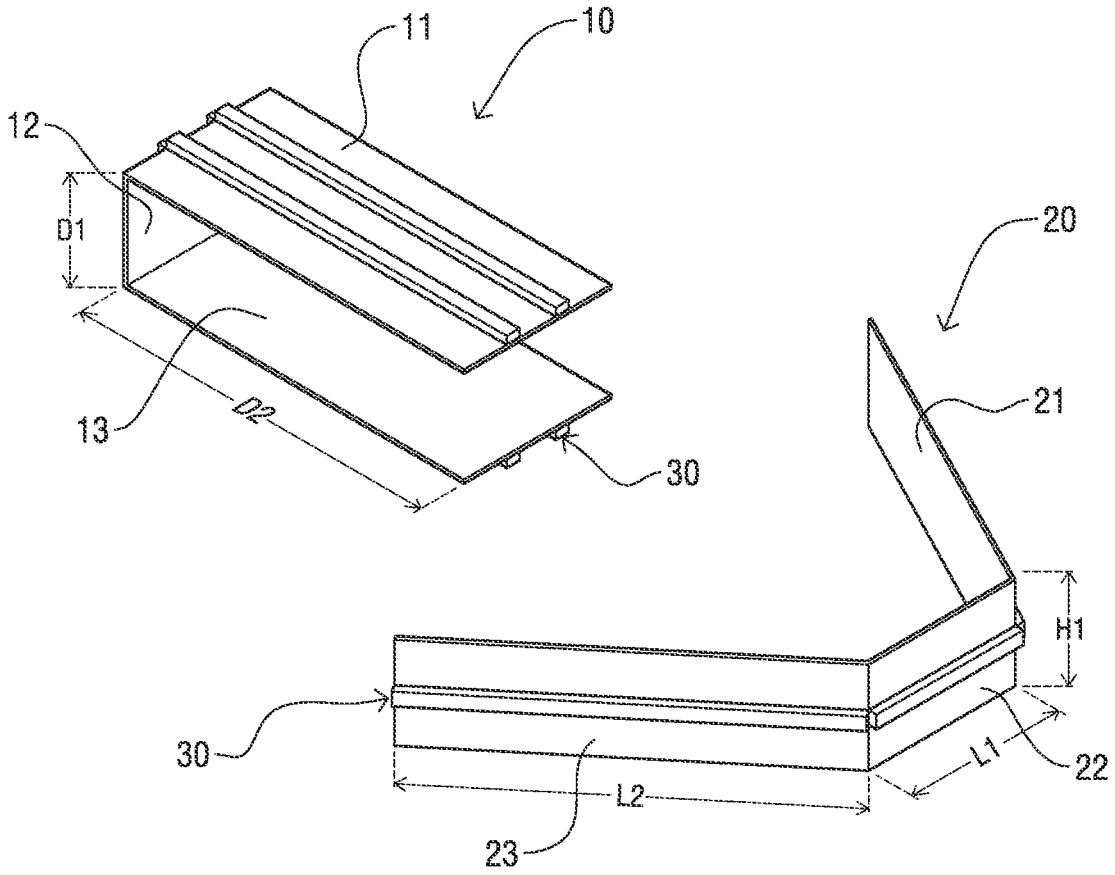
FIG. 13 is a top perspective expanded view of the two liner components of the insulation box liner of an embodiment of the present invention that are transversely oriented for installation into an outer shipping carton.

In the next step, as seen in FIG. n, the inner planar member 31 of the bar-type standoffs 30 are adhered to the outer casing 70 by the adhesive 32 (FIG. 9). In the next step of the method, as seen in FIG. 12, the adhered bar-type standoffs 30 are cut or slit at cut lines 33 to allow the liner components 10, 20 to be folded at crease lines 45. The cut lines 33 are generally in line with the crease lines 45. Then, as seen in FIG. 13, the liner components 10, 20 can be folded and interlocked to form the liner 50.

In the first embodiment, to create the insulation liner 50 that is to be inserted into the outer carton 60 (FIG. 1) the larger folded component 10 is folded in a squared U-shaped configuration with a first wing panel 11, a middle second panel 12, and a third wing panel 13, as seen in FIG. 3. Corner 15 is disposed between the first panel 11 and the middle/second panel 12. Corner 16 is disposed between the middle/second panel 12 and the third panel 13. Similarly, the smaller folded component 20 is folded in a squared U-shaped configuration with a first wing panel 21, a middle second panel 22, and a third wing panel 23. Corner 25 is disposed between the first panel 21 and the middle/second panel 22. Corner 26 is disposed between the middle/second panel 22 and the third panel 23.

The larger component 10 is inserted into the outer shipping carton 60 with the third panel 13 placed in parallel with the carton bottom with the outer surface of the attached standoffs 30 resting on the inner surface 65 of the carton bottom. Therefore, the plane of the third panel 13 is offset from the substantially parallel plane of the carton 60 a distance substantially equal to the height of the standoffs 30. The middle panel 12 is placed in a plane parallel with the plane of the carton side but offset substantially the height of the standoff 30. The slightly smaller component 20 is manually folded into a squared U-shape and positioned with the panels 21, 22, 23 in planes parallel to the planes of the corresponding sides of the shipping carton 60 but offset a distance substantially equal to the height of the standoffs 30. The object or objects to be shipping are placed into the liner 50 (with or without packing material). Then the first panel 11 is folded downwardly to form a lid. The top of the carton 60 is closed with the first panel 11 positioned in a plane offset from the substantially parallel plane of the top of the carton 60 a distance substantially equal to the height of the standoffs.

Preferably the inner core 40 and the outer casing 70 of the larger component 10 are slightly larger than the inner core 40 and the outer casing 70 of the smaller component 20 due to the method of assembling the liner 50 within the outer carton 60 in which the smaller component edges rest upon or slightly within the larger component edges. When oriented as shown in FIGS. 1-3, the longitudinal edge 79 (FIG. 4) of the first panel 21 of the smaller component 20 will rest near a first longitudinal edge 78 (FIG. 4) of the bottom third panel 13 of the larger component 10, the longitudinal edge 79 of the second panel 22 of the smaller component 20 will rest near the lateral edge 71 of the bottom third panel 13 of the larger component 10, and the longitudinal edge 79 of the third panel 23 of the smaller component 20 will rest near the second longitudinal edge 14 of the bottom third panel 13 of the larger component 10. When the top first panel 11 of the larger component 10 is folded over onto the smaller component 20, the opposing longitudinal edges 24 will rest against the corresponding parts of the top first panel 11 of the larger component 10.

For a shipper to use the insulation liner 50 of the first embodiment, an outer shipping carton 60 is obtained along with the two parts (the larger liner component 10 and the smaller liner component 20) of the insulation liner 50. As seen in FIG. 2, the third panel 13 of the folded larger component 10 is placed in the bottom of the outer shipping carton 60 with the outer planar member 39 of the standoffs 30 resting against the inner bottom wall of the outer shipping carton 60. The standoffs 30 maintain a distance between the outside of the third panel 13 and the inside bottom wall of the outer shipping carton 60, and they maintain the third panel 13 generally parallel to the bottom wall of the shipping carton 60. The second panel 12 of the folded larger component 10 is then bent at a ninety-degree angle and positioned in parallel with a side wall of the shipping carton 60 with the standoffs 30 holding the second panel 12 a distance from the inner wall 65 of the shipping carton 60.

Then the smaller component 20 is folded to form a squared U-shape and is slid into the shipping carton 60 with all three panels 21, 22, 23 at substantially ninety-degree angles and positioned vertically and substantially parallel with the carton sides. The exteriorly-projecting standoffs 30 on each side support the smaller component 20 a distance from the inner walls 65. This forms a hollow interior space 55 (FIG. 2) defined by the walls of the inner liner box 50 into which the object (one or more articles or items) to be shipped are then placed. Packing material may be added within the interior space 55 of the liner 50, if needed, to support the object(s) to be shipped or to reduce the chance that one object will damage another object. Optionally, packing material or wispy material 95 to reduce air circulation may be added within the interstitial air space 90. Then the first panel of the larger component 10 is folded to close the top of the hollow space 55. The longitudinal edges of the smaller component 20 abut the inner outer casing surface 17 of the first and third panels 11, 13 of the larger components 10. The lateral edges of the smaller component 20 abut the longitudinal edges of the middle second panel 13 of the larger component to substantially eliminate gaps, but do not form so tight a seal that humidity is a problem. The insertion of the two components 10, 20 into the outer shipping carton 60 causes the liner 50 to be dimensionally stable. The liner 50 is held in a no-slip position and in the proper shape in an interlocking, transverse manner without the use of connecting elements linking or joining the two liner components 10, 20.

When the carton system 80 is received by the recipient, the recipient unpacks the contents of the parcel, opens the top panel 11, and removes the shipped object(s). The recipient then can extract the liner 50 from the carton 60 for recycling and disposal. The inner core 40 of the insulation liner 50 can be removed from the outer casing 70. The standoffs 30 can be removed from the outer casing 70. Then the outer carton 60, the standoffs 30, and the inner core 40 can be recycled with the appropriate category of recyclables (generally paper).

The liner 50 inserted into the outer shipping carton 60 creates the insulation effect through minimization of convection, conduction and thermal radiation. Due to the creation of the interstitial space 90 between the liner 50 and the outer carton 60, the insulation liner and carton system 80 greatly reduces conduction compared to a conventional molded polystyrene or starch-based foam container. In testing, the liner/carton system 80 performed as well as, or better than, a conventional 1.5-inch foam container but is much more economical to transport and to store. Additionally, the reflective outer casing forms a radiant barrier that reflects a large percentage of radiant heat. In one aspect, the reflective outer casing is metalized. (Different metals reflect different amounts of radiant heat, for example, up to 98 percent of radiant heat when the metal is an aluminum foil and up to 99 percent of radiant heat if copper foil is used). Convection is reduced by restricting the movement of the air through the use of standoffs 30. In an aspect of the invention, convection may be further reduced by using corrugated fiberboard for the inner core 40. In a further aspect, bubble foam material may be selected for the outer casing 70 to impede air movement. In another aspect, convention may be reduced by the introduction of a wispy material 95 (such as a light polyester fiber or airy paper strips) into the interstitial space.

Figure 14:
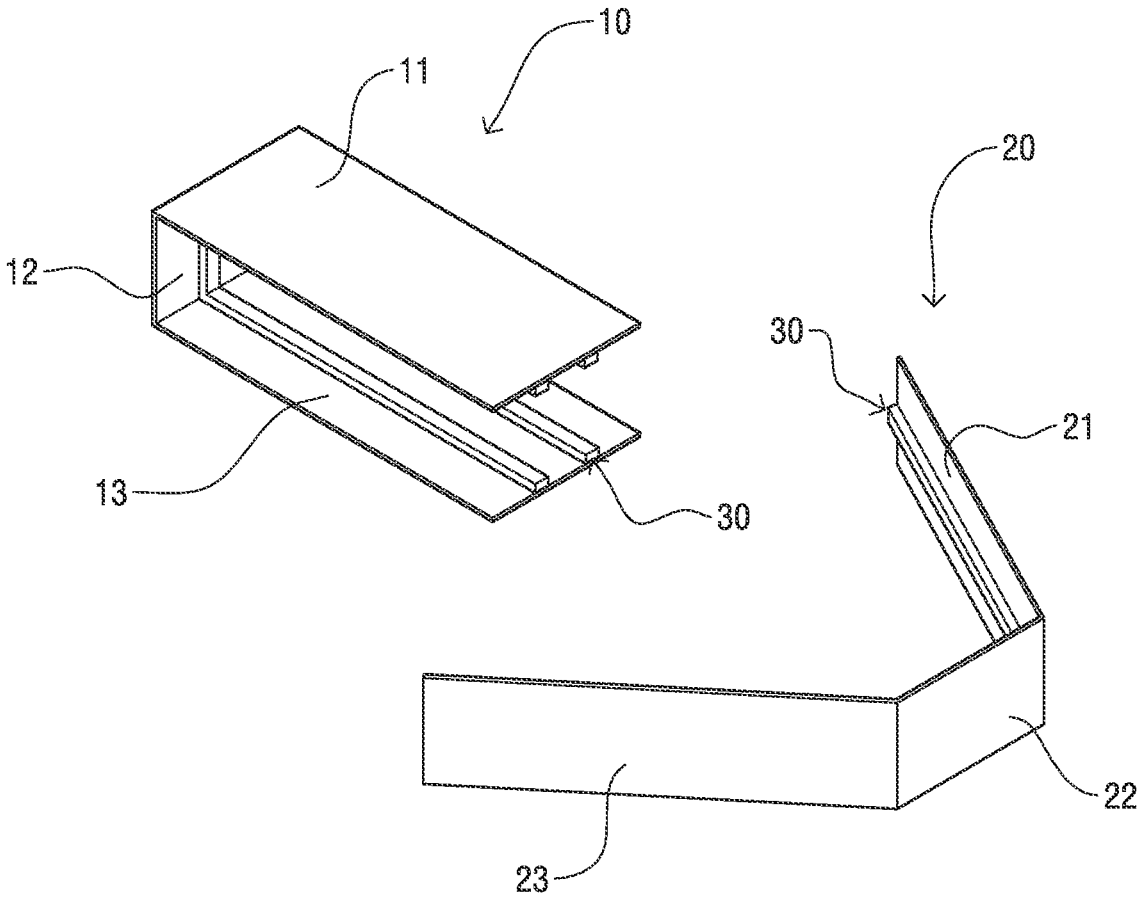
FIG. 14 is a top perspective expanded view of the two liner components of the insulation box liner of a second embodiment of the present invention that are transversely oriented for installation into an outer shipping carton with the standoffs oriented inwardly.

The second embodiment of FIG. 14 shows an alternative configuration in which the standoffs 30 are disposed inwardly. The two components 10, 20 that form the liner 50 may be formed in the same way as in the first embodiment, but the liner components 10, 20 are bent in the opposite direction at crease lines 45 to orient the standoffs 30 inwardly, instead of outwardly. Then the liner components 10, 20 are installed into the outer shipping carton 60 with the standoffs 30 oriented inwardly.

In the second embodiment, to create the insulation liner 50 that is to be inserted into the outer carton 60 (FIG. 1) the larger folded component 10 and the smaller component 20 are folded into squared U-shaped configurations, but with the standoffs oriented inwardly and with the outer sides of the panels of the larger and smaller liner components placed adjacent and parallel to the inner walls 65 of the carton 60. The outer surfaces of the panels are not offset from the surfaces of the corresponding walls the height of the standoffs but are instead adjacent to the corresponding walls.

This embodiment may find particular usage in the catering industry, which employs large serving trays to hold the food product. The tray containing the food product may be held securely within the insulation liner 50 and may be maintained within a preferred temperature range during transport. For example, the larger liner component may be formed with the standoffs 30 disposed on the bottom wing panel 13 positioned upwardly and with the standoffs 30 disposed on the middle panel 12 disposed inwardly, and the slightly smaller component is formed with the standoffs 30 positioned inwardly. The bottom wing panel 13 is then placed into the bottom of the shipping carton 60 with the middle panel bent upwardly at a ninety-degree angle. The smaller component 20 is then folded and placed in the shipping carton 60 to form the sides of the liner 50. A hot or cold tray may be placed within the interior space of the liner 50 to rest upon the standoffs 30 on the wing panel 13, with the inwardly-disposed standoffs 30 of the larger component middle panel 12 and the inwardly-disposed standoffs 30 of the smaller component panels 21, 22, 23 supporting the sides of the hot or cold tray. The top panel 11 is folded at a ninety-degree angle and positioned to form a top over the food tray lid, which provides additional support to the food tray. In combination (when the liner is sized to the tray), the tray is held securely in position. The heat or cold is retained in the food product, due to the advantages of the liner 50.

Thus, the liner 50 is versatile in that it can be disposed with the standoffs 30 turned inwardly, as in the first embodiment, or outwardly, as in the second embodiment.

In another aspect, a separate insulated box insert may be installed within the interior space of the liner 50 before the top panel 11 is folded at a ninety-degree angle and positioned to form a lid. The box insert may be desirable for instances in which the object(s) to be shipped may be particularly temperature sensitive or the shipping environment may be particularly hostile. The box insert may be a second inventive box liner 50 or a conventional insulated container, such as a polystyrene cooler.

In the embodiments, both the larger and smaller liner components 10, 20 have a thickness that is substantially equal to the thickness of the inner core 40 plus the thickness of the outer casing 70.

The outer shipping carton 60 is typically formed of C-flute corrugated fiberboard that has a manufacturer's joint joined with adhesive. It may typically be a regular slotted container (RSC) in which all flaps are the same length from score to edge. Optionally, other box types may be used, such a full overlap box (FOB) in which the major flaps fully overlap to provide extra stacking strength and edge protection. Other types of corrugated fiberboard may also optionally be selected based on such factors as the size and weight of the object to be shipped.

The insulation liner 50 reduces shipping costs, product storage costs, and retail display shelf space compared to foam containers, because the two liner components 10, 20 can be shipped, stored, or displayed flat or, optionally, with the three panels of each of the components 10, 20 folded at the creases. The positioning of the standoffs 30 on the larger component 10 can easily be offset from the positioning of the standoffs 30 of the smaller component to facilitate compact transportation, storage, and retail display.

Furthermore, most parts of the liner/carton system 80 are recyclable and can be made of recycled materials. The outer carton 60 is typically made of corrugated fiberboard, which is recyclable and can be made of recycled materials. The inner core 40 of the insulation liner 50 and the standoffs 30 can also be made of recycled or virgin corrugated fiberboard, which can also be recycled.

In addition, though the tooling cost for foam containers is in the thousands of dollars, there are no molds required to form the liner 50. Consequently, manufacturing costs for the insulation liner 50 are reduced compared to conventional foam liners, and more sizes and shapes of liners 50 can be economically offered.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An insulation box liner for installing in a shipping carton, comprising:

a larger component comprising:

(1.) a larger component inner core comprising a flat sheet of core material; wherein, when said larger component is folded into a larger U-shape, three larger component panels are formed, each of said three larger component panels having a larger component outer surface facing outward; and (2.) a larger component outer casing disposed adjacent to said larger component outer surface;

larger component standoffs fixedly attached adjacent to said larger component outer casing on each of said three larger component panels; wherein each of said larger component standoffs comprises a larger outer planar member, a larger vertically extending portion, and a larger inner planar member; wherein said larger inner planar member is fixedly attached to said larger component outer casing;

a smaller component comprising:

(1.) a smaller component inner core comprising a flat sheet of core material; wherein, when said smaller component is folded into a smaller U-shape, three smaller component panels are formed, each of said three smaller component panels having a smaller component outer surface facing outward; and (2.) a smaller component outer casing disposed adjacent to said smaller component outer surface;

smaller component standoffs fixedly attached adjacent to said larger component outer casing on each of said three smaller component panels; wherein each of said smaller component standoffs comprises a smaller outer planar member, a smaller vertically extending portion, and a smaller inner planar member; and wherein said smaller inner planar member is fixedly attached to said smaller component outer casing;

wherein, when said smaller U-shape is inserted into said shipping carton, said smaller U-shape is positioned transversely to said larger U-shape, and an air gap is maintained at a fixed, pre-determined distance between said shipping carton and said insulation box liner by said larger component standoffs and said smaller component standoffs; and wherein each of said larger component standoffs hold said larger component a fixed, pre-determined distance from an inner wall of said shipping carton to form a first portion of said air gap; and wherein each of said smaller component standoffs hold said smaller component a fixed, pre-determined distance from said inner wall of said shipping carton to form a second portion of said air gap.

2. The insulation box liner as recited in claim 1, wherein:

said three larger component panels comprise a larger component middle panel having a length D1; and said smaller component has a height H1 that is equal to or less than said length D1.

3. The insulation box liner as recited in claim 1, wherein:

said smaller component standoffs comprise first bar-type standoffs; and said larger component standoffs comprise second bar-type standoffs.

4. The insulation box liner as recited in claim 1, wherein:

said smaller component standoffs comprise first cylindrical standoffs; and said larger component standoffs comprise second cylindrical standoffs.

5. The insulation box liner as recited in claim 1, wherein:

said smaller component standoffs comprise first rectangular standoffs; and said larger component standoffs comprise second rectangular standoffs.

6. The insulation box liner as recited in claim 1, wherein:

said smaller component standoffs consist of a first corrugated material; and said larger component standoffs consist of a second corrugated material.

7. The insulation box liner as recited in claim 1, wherein:

said larger component outer casing comprises a larger component envelope;

said larger component inner core is disposed within said larger component envelope;

said smaller component outer casing comprises a smaller component envelope; and said smaller component inner core is disposed within said smaller component envelope.

8. The insulation box liner as recited in claim 7, wherein:

said larger component inner core consists of a first corrugated fiberboard; and said smaller component inner core consists of a second corrugated fiberboard.

9. The insulation box liner as recited in claim 1, wherein:

said larger component outer casing comprises a first reflective material; and said smaller component outer casing comprises a second reflective material.

10. An insulation box liner for installing in a shipping carton, comprising:

a larger component comprising a larger component inner core that is substantially flat and a larger component outer casing formed of a reflective material; wherein said larger component outer casing is disposed adjacent to an outer surface of said larger component inner core; and wherein said reflective material is disposed adjacent to said outer surface of said larger component inner core;

multiple larger component standoffs; wherein said larger component comprises three larger component panels separated by crease lines; wherein said three larger component panels comprise a larger component first panel, a larger component middle second panel, and a larger component third panel; wherein said multiple larger component standoffs are disposed adjacent to said reflective material;

a smaller component comprising a smaller component inner core that is substantially flat and a smaller component outer casing formed of a reflective material; wherein said smaller component outer casing is disposed adjacent to an outer surface of said smaller component inner core; and wherein said reflective material is disposed adjacent to said outer surface of said smaller component inner core; and multiple smaller component standoffs; wherein said smaller component comprises three smaller component panels separated by crease lines; wherein said three smaller component panels comprise a smaller component first panel, a smaller component middle second panel, and a smaller component third panel; wherein said multiple smaller component standoffs are disposed adjacent to said reflective material; wherein height H1 of said smaller component middle second panel is equal to or less than length D1 of said larger component middle second panel; and wherein, when said smaller component is inserted into said shipping carton, said smaller component is positioned transversely to said larger component, and an air gap of a fixed, predetermined distance is maintained between said insulation box liner and said shipping carton by said multiple larger component standoffs and said multiple smaller component standoffs.

11. The insulation box liner as recited in claim 10, wherein said reflective material of said larger component outer casing and said reflective material of said smaller component outer casing consists of a foil-faced bubble wrap material.

12. The insulation box liner as recited in claim 10, wherein:

said multiple smaller component standoffs comprise a bar-type standoff formed of at least one strip of material adhesively adhered to, and extending outwardly from, said smaller component outer casing; and said multiple larger component standoffs comprise a bar-type standoff formed of at least one strip of material adhesively adhered to, and extending outwardly from, said larger component outer casing.

13. The insulation box liner as recited in claim 10, wherein:

said multiple smaller component standoffs comprise smaller component segments of a honeycomb corrugated material; and said multiple larger component standoffs comprise larger component segments of said honeycomb corrugated material.

* * * * *